United States Patent [19]

Surface

[11] Patent Number: 4,782,606

[45] Date of Patent: Nov. 8, 1988

[54] METHOD AND APPARATUS FOR BACKFILLING DITCHES

[76] Inventor: Kelly Surface, 4223 Mountain View Rd., Roanoke, Va. 24017

[21] Appl. No.: 44,641

[22] Filed: May 1, 1987

[51] Int. Cl.[4] ..... E02F 5/22

[52] U.S. Cl. ..... 37/117.5; 37/142.5; 37/DIG. 12; 414/414; 414/724

[58] Field of Search ..... 37/142.5, 117.5, DIG. 3, 37/DIG. 12; 414/414, 724

[56] References Cited

U.S. PATENT DOCUMENTS

| | | | |
|---|---|---|---|
| 1,112,016 | 9/1914 | MacLachlan | 37/142.5 |
| 3,011,278 | 12/1961 | Lust | 37/142.5 |
| 4,633,602 | 1/1987 | Layh et al. | 37/142.5 X |

FOREIGN PATENT DOCUMENTS

| | | | |
|---|---|---|---|
| 199927 | 11/1984 | Japan | 37/142.5 |
| 1380398 | 1/1975 | United Kingdom | 37/142.5 |

*Primary Examiner*—David Wiecking
*Assistant Examiner*—Moshe I. Cohen
*Attorney, Agent, or Firm*—Norman B. Rainer

[57] ABSTRACT

A method and apparatus are provided for more efficiently backfilling a ditch in the ground. The apparatus is comprised of a rigid compartment adapted to be pendantly supported by the dumping scoop of a front end loader vehicle. The compartment has an inclined floor and a closeable aperture located at the lowermost extremity of the floor. Backfill material dumped from the scoop falls into the compartment and is diverted horizontally a sufficient extent to enter the ditch. By virtue of the apparatus and its manner of association with the dumping scoop, the front end loader can fill the ditch merely by riding a continuous path parallel to the ditch.

6 Claims, 2 Drawing Sheets

METHOD AND APPARATUS FOR BACKFILLING DITCHES

BACKGROUND OF THE INVENTION

This invention concerns the backfilling of ditches dug into the ground for the purpose of laying subterranean pipelines and electrical cables and for other purposes, and more particularly relates to apparatus adapted to use with a front end loader for the backfilling of ditches.

In the digging of elongated ditches for the underground placement of pipes, cables and the like, the excavated soil is generally piled alongside the ditch. In the backfilling operation, the excavated soil or other backfill material is usually handled by a front end loader apparatus comprised of a tractor having on it forward extremity a dumpable scoop elongated perpendicularly to the tractor's path of travel. In such backfilling, the front end loader must make repeated step-wise perpendicular approaches to the ditch so that, when the scoop is dumped above the ditch, its elongated dimension is parallel to the direction of elongation of the ditch.

The repeated cyclical pattern of movement of the front end loader is wasteful of fuel and operator time, and produces considerable wear upon the apparatus.

It is accordingly an object of this invention to provide an improved method for filling elongated ditch-like excavations.

It is another object of this invention to provide a method for simplifying the backfilling of elongated ditches by a front end loader.

It is a further object of the present invention to provide an apparatus for removable attachment to said front end loader to simplify the backfilling of elongated ditches.

It is still another object of the present invention to provide attachment apparatus of the aforesaid nature of rugged and durable construction amenable to low cost manufacture.

These objects and other objects and advantages of the invention will be apparent from the following description.

SUMMARY OF THE INVENTION

The above and other beneficial objects and advantages are accomplished in accordance with the present invention by a process wherein a self-propelled vehicle having a cargo compartment is caused to travel in close parallel relationship to a ditch to be backfilled, and is caused to uniformly discharge its cargo of backfill material downwardly by gravity fall into diverting means which horizontally displaces said material during its fall by a sufficient distance to enter said ditch.

The apparatus of the present invention is intended for removable association with the rectangularly elongated dumping scoop of a front end loader. Said apparatus is comprised of:

(a) a rigid compartment having: (1) an open upper extremity having an elongated rectangular perimeter comprised of paired short edges and long edges, (2) identical opposed flat front and rear walls, each having a horizontally disposed upper edge that constitutes a long edge of said rectangular perimeter, and having at least one upright side edge, said walls being disposed such that said side edges are in facing juxtaposition and convergent in the downward direction, (3) at least one flat end panel of generally trapezoidal perimeter having a horizontally disposed upper edge that constitutes a short edge of the rectangular perimeter of said upper extremity, two side edges in joinder with the side edges of said front and rear walls, a horizontally disposed lower edge, and an exit port positioned adjacent the lower edge of one end panel, (4) a bottom panel extending between said front and rear walls and downwardly inclined toward the lower edge of the end panel which has said exit port, and (5) valve means associated with said exit port, and (b) support means comprised of paired harnesses, each having a transverse tether attached to diametrically opposed sites on said front and rear walls adjacent their upper edges and extending upwardly in a compliant V-shaped path having joining means at its apex, and a lifting tether attached at its lower extremity to said joining means and having an upper extremity adapted to attach to the rearward edge of the rectangular dumping scoop, the sites of attachment of said tranverse tethers being adjacent said short edges and equally spaced from the midline axis between said short edges.

In preferred embodiments of the apparatus, the compartment is configured to have a vertical plane of symmetry that bisects the short edges of the open upper extremity. Four support legs may extend beneath the compartment. The tethers are preferably chain or steel cable, and the sites of attachment of the traverse tethers may utilize apertures in said walls or in tabs welded The valve means, which may be a flapper-type valve, may be associated with said pouring spout.

BRIEF DESCRIPTION OF THE DRAWING

For a fuller understanding of the nature and objects of the invention, reference should he had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
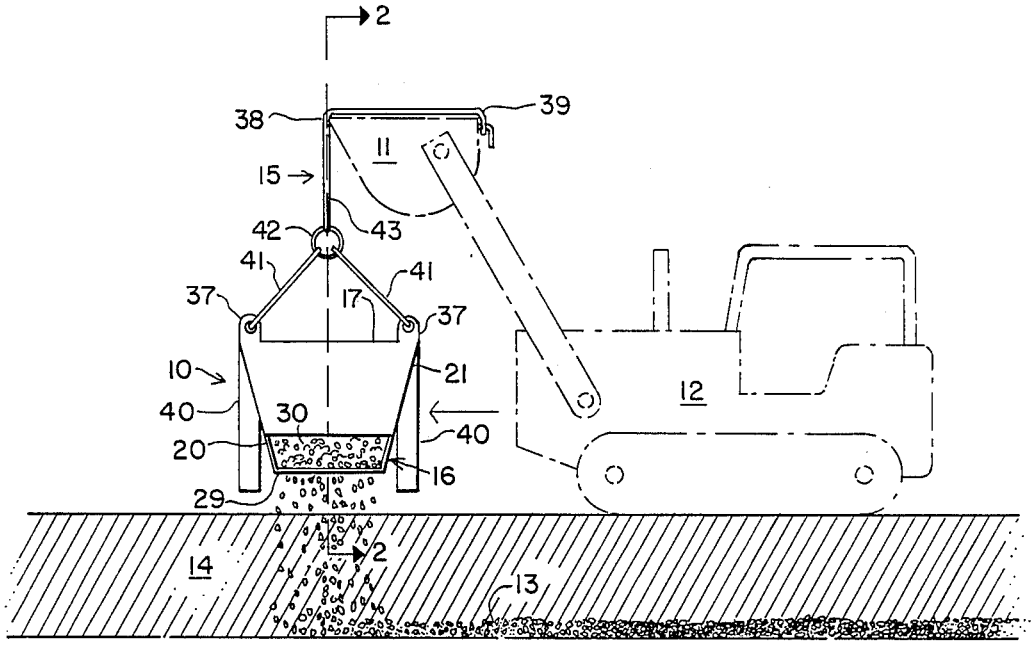
FIG. 1 is a side view of an embodiment of the apparatus of the present invention shown in operative association with a front-end loader and disposed to back fill a ditch.

Referring to FIG. 1, an embodiment of the apparatus 10 of the present invention is shown suspended from the rectangularly elongated dumping scoop 11 of front end loader 12, said scoop having forward edge 38 and rearward edge 39. A stream of gravel 13 is shown emerging from the apparatus to form an accumulation in the bottom of ditch 14 which is elongated in the direction of travel of the front end loader.

Figure 2:
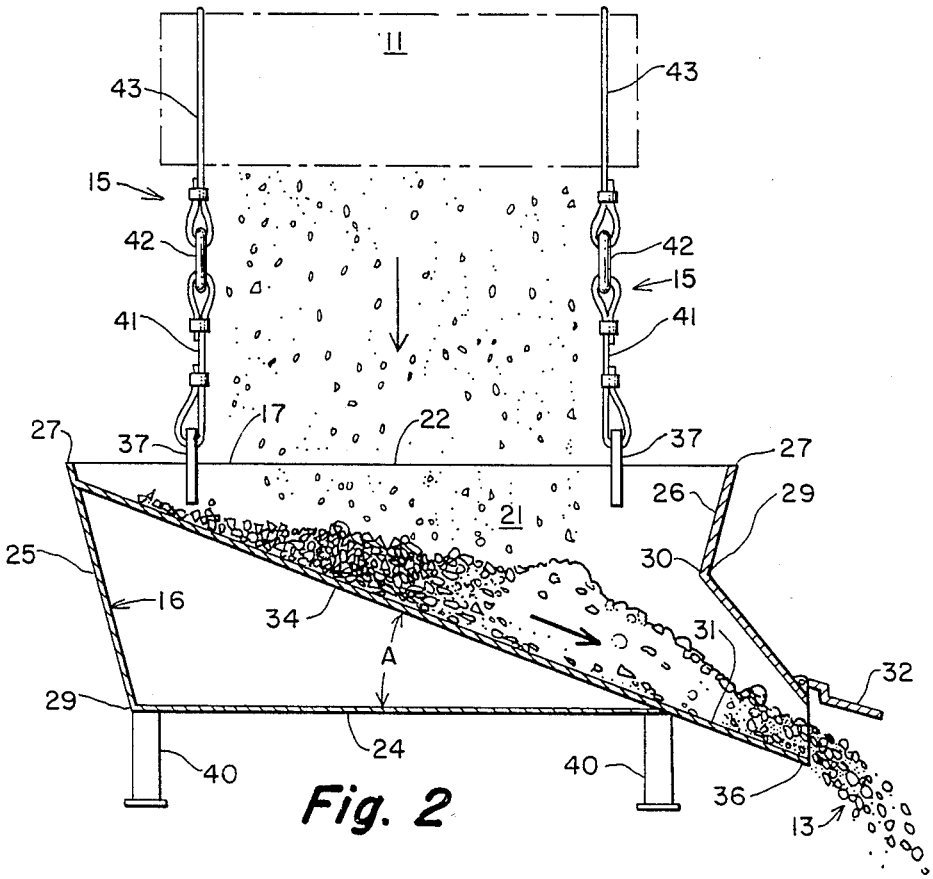
FIG. 2 is an enlarged sectional view taken along the line 2—2 of FIG. 1.
Figure 3:
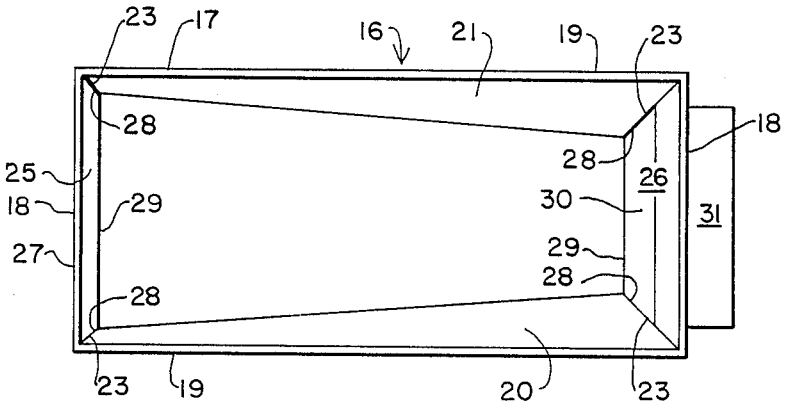
FIG. 3 is a top view of the apparatus of FIG. 1.

As shown more clearly in FIGS. 2 and 3, apparatus 10 is comprised of rigid compartment 16 suspended by paired harnesses 15.

Compartment 16, preferably fabricated of plate steel, has an open upper extremity 17 having an elongated rectangular perimeter comprised of paired short edges 18 and long edges 19. Identical flat front and rear walls 20 and 21, respectively, are in opposed relationship, each having a trapezoidal shape defined by a horizontally disposed upper edge 22 that constitutes a long edge 19 of said rectangular perimeter, side edges 23, and lower edge 24. Side edges 23 are convergent in the downward direction. Left and right flat end panels 25 and 26, respectively, are in opposed relationship, each having a trapezoidal shape defined by a horizontally disposed upper edge 27 that constitutes a short edge 18 of said rectangular perimeter, two side edges 28 welded to the side edges 23 of said front and rear walls, and lower edges 29. The side edges 28 are convergent in the downward direction.

An exit port 30 is positioned in right end panel 26 below lower edge 29, said port extending between walls 20 and 21 and representing the space formed by truncation of the lower extremity of right end panel 26. A pouring spout 31 extends downwardly from exit port 30, and the extremity of the spout is equipped with valve means in the form of pivoted flapper plate 32.

An inclined, flat bottom panel 34 fills the space between front and rear walls 20 and 21, respectively, and left and right end panels 25 and 26, respectively. The lowermost edge 36 of the bottom panel serves as the lower edge of pouring spout 31. The angle of inclination of bottom panel 34 with respect to horizontal lower edges 24, designated angle A in FIG. 2, is between 30 and 45 degrees.

It is to be noted that the lower extremity of compartment 16, except for spout 31, is comprised of the straight lower edges of the front and rear walls and left end panel. Said lower edges are in coplanar alignment, forming a substantially rectangular perimeter smaller than the upper perimeter of the compartment. In alternative embodiments, however, the lower extremity of compartment 16 may be bottom panel 34 since the portions of the front and rear walls and left end panel disposed below bottom panel 34 serve no practical purpose except for balance and fabricational simplification. Four vertically disposed legs 40 are attached to the compartment in a rectangular locus, thereby enabling the container to stand upright when placed upon the ground.

Each harness 15 is comprised of transverse tether cables 41 removably fastened to apertures in tabs 37 welded in diametrically facing disposition to upper edges 22 of said end panels. Cables 41 extend upwardly to engagement with joining ring 42 centered in the vertical plane of symmetry that bisects short edges 18. A lifting tether cable 43 is attached at its lowermost extremity to ring 42, and secured at its uppermost extremity to rearward edge 39 of the scoop. By virtue of such arrangement, compartment 16 can be suspended from the dumping scoop in both the upright and dumped states of the scoop, as shown in FIGS. 1 and 2, respectively. In the dumped state, backfill material such as gravel, sand, crushed rock, earth, concrete, or other pourable materials will fall by gravity into compartment 16 which diverts the material laterally so that it falls into a ditch located alongside the front end loader. Because of its specialized features of construction, the apparatus of this invention can be easily associated with the scoop and easily controlled by the operator of the front end loader. Flapper plate 32 may be manipulated by the operator by suitable control linkages, or may be manipulated by an assistant worker.

Figure 4:
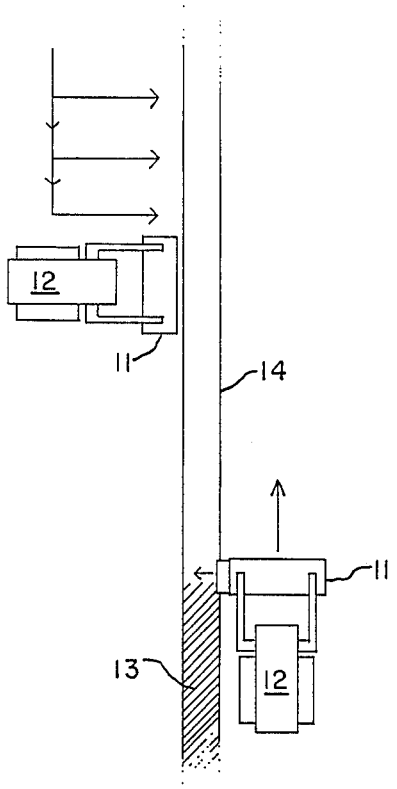
FIG. 4 is a schematic top view illustrating the method of this invention in comparison with the method of the prior art.

In the backfilling method of the present invention, the front-end loader, having the apparatus of this invention suspended from the scoop, travels in a path parallel to and closely adjacent the ditch, as shown on the right side of FIG. 4. The scoop is inverted to discharge its contents of backfill material into compartment 16. While the front end loader travels at a uniform rate, the backfill material is directed into the ditch under the control of valve means 32. By way of contrast, a front end loader functioning by the prior art method, as shown on the left side of FIG. 4, travels a more extensive path to accomplish the same result.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. Diverting apparatus adapted for removable association with a rectangularly elongated dumping scoop of a front end loader, said apparatus comprising:

(a) a rigid compartment having: (1) an open upper extremity having an elongated rectangular perimeter comprised of paired short edges and long edges, (2) identical opposed flat front and rear walls, each having a horizontally disposed upper edge that constitutes a long edge of said rectangular perimeter, and having at least one upright side edge, said walls being disposed such that said side edges are in facing juxtaposition and convergent in the downward direction, (3) at least one flat end panel of generally trapezoidal perimeter having a horizontally disposed upper edge that constitutes a short edge of the rectangular perimeter of said upper extremity, two side edges in joinder with the side edges of said front and rear walls, a horizontally disposed lower edge, and an exit port positioned adjacent the lower edge of one end panel, (4) a bottom panel extending between said front and rear walls and downwardly inclined toward the lower edge of the end panel which has said exit port, and (5) valve means associated with said exit port, and (b) support means comprised of paired harnesses, each having a transverse tether attached to diametrically opposed sites on said front and rear walls adjacent their upper edges and extending upwardly in a V-shaped path having joining means at its apex, and a compliant lifting tether attached at its lower extremity to said joining means and having an upper extremity adapted to attach to the rearward edge of the rectangular dumping scoop, the sites of attachment of said transverse tethers being adjacent said short edges and equally spaced from the midline axis between said short edges.

2. The apparatus of claim 1 wherein said compartment has a vertical plane of symmetry that bisects the short edges of the open upper extremity.

3. The apparatus of claim 2 wherein four support legs extend beneath the compartment in a rectangular locus.

4. The apparatus of claim 1 wherein the sites of attachment of the transverse tethers comprise apertures in said sidewalls.

5. The apparatus of claim 1 wherein a pouring spout is associated with the exit port.

6. The apparatus of claim 5 wherein said valve means is associated with said pouring spout.

* * * * *